US006611730B1

(12) United States Patent
Stoll et al.

(10) Patent No.: US 6,611,730 B1
(45) Date of Patent: Aug. 26, 2003

(54) DEVICE AND METHOD OF DESIGNING KNIT PRODUCTS TO BE MANUFACTURED ON A KNITTING MACHINE

(75) Inventors: Thomas Stoll, Reutlingen (DE); Juergen Hermann, Kirchentellinsfurt (DE); Helmut Bruendl, Reutlingen (DE); Horst Fries, Reutlingen (DE); Hermann Weiss, Reutlingen (DE); Michael Haug, Dettingen (DE); Karsten Stello, Reutlingen (DE); Gerhard Ertl, Graz (AT)

(73) Assignee: H. Stoll GmbH & Co., Reutlingen (DE)

( * ) Notice: Subject to any disclaimer, the term of this patent is extended or adjusted under 35 U.S.C. 154(b) by 0 days.

(21) Appl. No.: 09/483,953

(22) Filed: Jan. 14, 2000

(30) Foreign Application Priority Data

Jan. 16, 1999 (DE) ..... 199 01 542

(51) Int. Cl.[7] ..... G06F 19/00; D04B 7/24
(52) U.S. Cl. ..... 700/131; 700/141; 66/232
(58) Field of Search ..... 700/131, 132, 700/141, 97; 66/232

(56) References Cited

U.S. PATENT DOCUMENTS 4,608,642 A * 8/1986 Shima ..... 700/141
4,856,104 A * 8/1989 Stoll et al. ..... 700/141
5,557,527 A 9/1996 Kotaki
5,719,777 A 2/1998 Kotaki
5,754,431 A 5/1998 Kotaki

FOREIGN PATENT DOCUMENTS

| | | |
|---|---|---|
| DE | 44 01 742 A1 | 7/1995 |
| DE | 44 31 898 A1 | 3/1996 |
| EP | 0 640 707 A1 | 1/1995 |
| WO | WO 94/11794 | 5/1994 |

* cited by examiner

*Primary Examiner*—Peter Nerbun
(74) *Attorney, Agent, or Firm*—Michael J. Striker

(57) ABSTRACT

A device for designing knit products to be manufactured on a knitting machine includes at least one storage device for storing data required for the production of the knit products on the knitting machine; at least one display device for displaying design images for the knit products; and at least one input device for altering the design images. Data to be exchanged between the storage, input and display devices is processed to generate at least one knit image presentation and at least one corresponding thread course presentation for display as the design images on the display device, and one of the presentations is simultaneously correspondingly altered as the other is being altered by using the input device.

27 Claims, 15 Drawing Sheets

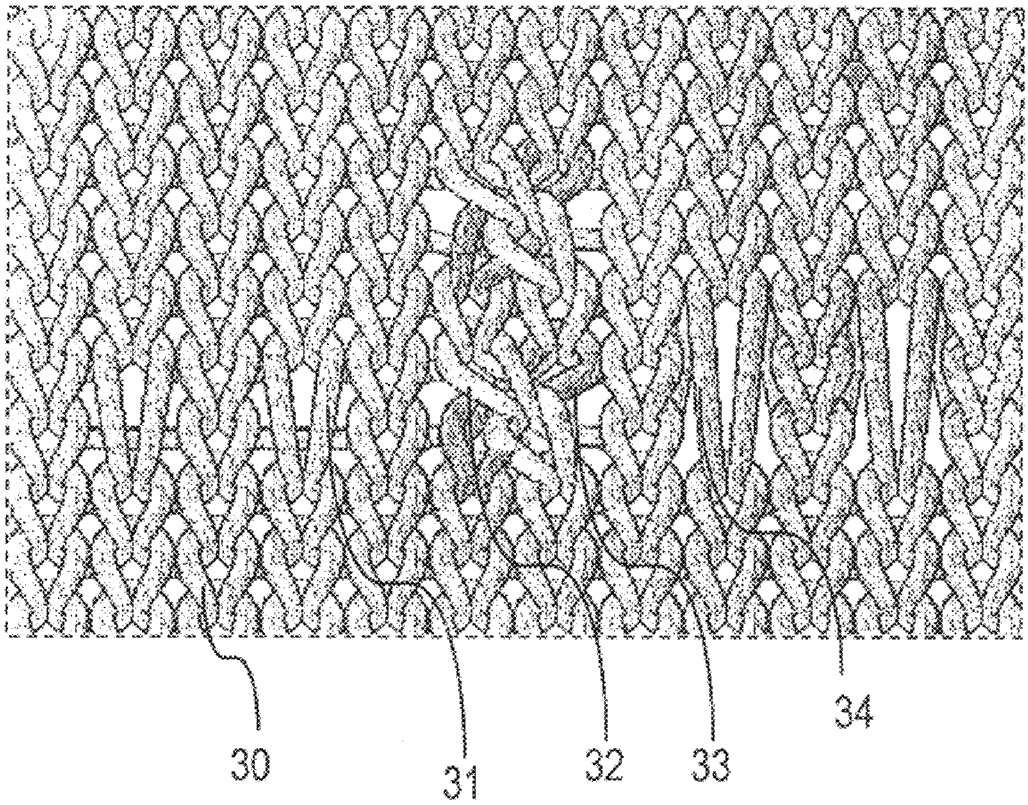
Fig. 4
Fig. 5
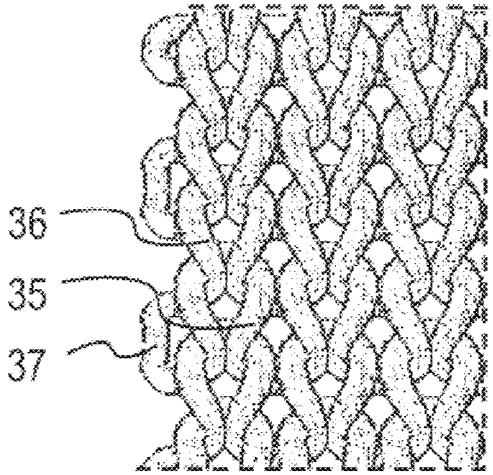

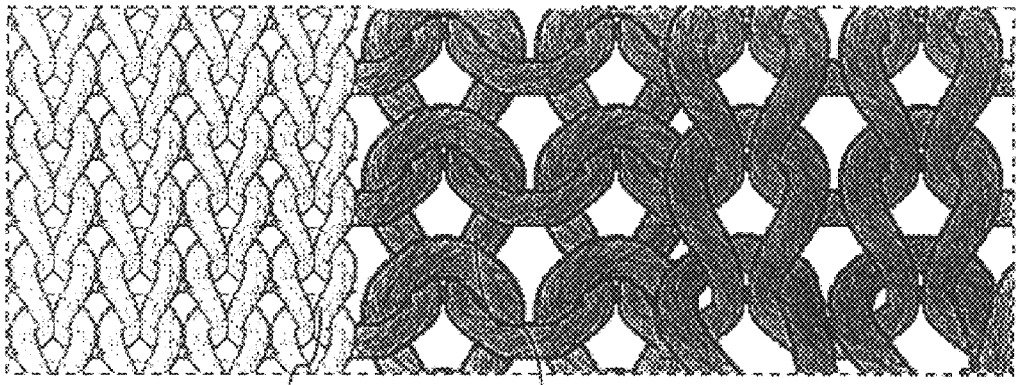
Fig. 7
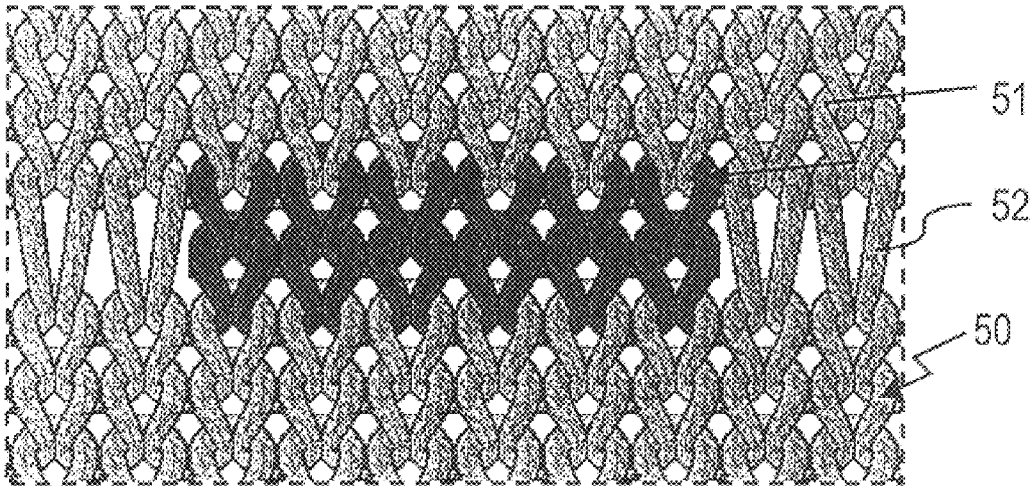
Fig. 8a
Fig. 8b
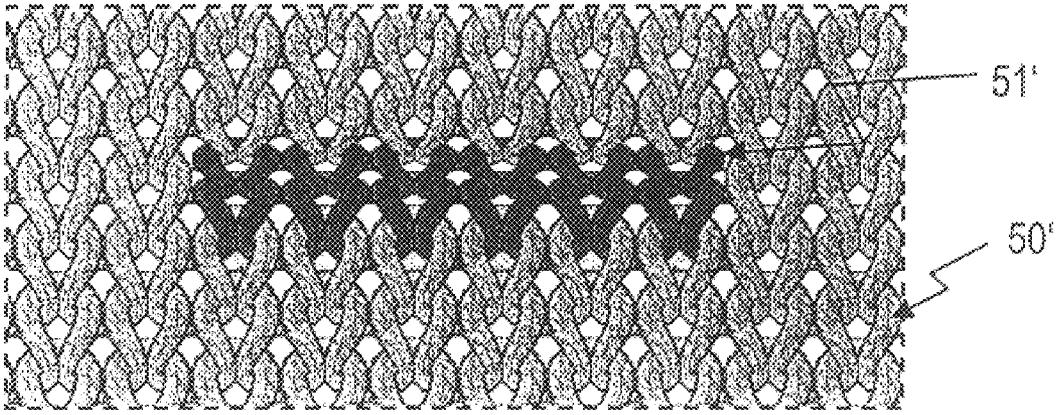

DEVICE AND METHOD OF DESIGNING KNIT PRODUCTS TO BE MANUFACTURED ON A KNITTING MACHINE

BACKGROUND OF THE INVENTION

1. Field of the Invention

The present invention relates to textile machinery in general, and more particularly to knitting machines and devices for designing knit images for the same.

2. Description of the Related Art

There are already known various constructions of devices for designing knit images for reproduction in knit products to be produced on knitting machines, among them those disclosed, for instance, in the published European patent document EP 0 640 707 A1, German patent document DE 44 31 898 A1 and the international patent document WO 94/11794. A device of this kind typically includes at least one storage device for storing data required for the production of the knit products on the knitting machine, at least one display device for displaying design images for the knit products, and at least one input device for altering the design images. By using such devices, it is possible to fully exploit the knitting capabilities of fully automated knitting machines. By using such devices, it is possible to manufacture knit products with complicated structures, highly complex color schemes or patterns, as well as complex contours or textures.

In the presently known designing devices of this kind, the input of the parameters of the knit product to be manufactured occurs in various input groups that can or must be edited separately. These input groups basically include shape instructions, color instructions, structure instructions, Jacquard instructions as well as loop size instructions. In addition to this, there must be entered yarn properties as well as machine parameters. From these instructions or input data, there are formed, by resorting to data processing techniques, control data on the basis of which a respective knitting machine is able to manufacture the desired knit product. The knit product is visualized on the display device of the designing apparatus, as a rule, in the form of a thread course presentation that depicts the knitting process—row by row—by respective symbols. In most known arrangements, the knit product is also entered into the system in this form and this information is subsequently converted by a conversion program into the control data for the knitting machine. In addition to that, the designing devices known from the above references are also equipped with other converting programs that are capable of converting or translating the thread course representation into a loop image representation that is capable of being then displayed. However, a direct conversion of a loop image representation into a thread course representation is not possible in these conventional devices.

As a result of the fact that the aforementioned designing devices require, for the generation of the design data for the knit product, the input of knit product instructions and of machine parameters and primarily display the thread course presentation of the knit product, they are predominantly aimed at a technically oriented user. For a style designer, who creates his or her designs in actual loop images, these designing devices are not suitable designing tools in that the loop image presentations can be generated in the known devices only in an operation following and resulting from the creation of the thread course presentation, so that the generation of the latter must be learned and mastered in order to be able to effectively employ the knit product designing device.

OBJECTS OF THE INVENTION

Accordingly, it is a general object of the present invention to avoid the disadvantages of the prior art.

More particularly, it is an object of the present invention to provide a knit product designing device that does not possess the drawbacks of the known devices of this type.

Still another object of the present invention is to devise a designing device of the type here under consideration which is suited for use not only by technically oriented, but also by more artistically leaning, users.

It is yet another object of the present invention to design the above designing device in such a manner as to allow its proficient use even by persons who are not familiar with thread course presentation symbols and generation techniques.

A concomitant object of the present invention is so to construct the device of the above type as to be relatively simple in construction, inexpensive to manufacture, easy to use, and yet reliable in operation.

SUMMARY OF THE INVENTION

In keeping with the above objects and others which will become apparent hereafter, one feature of the present invention resides in a device for designing knit products to be manufactured on a knitting machine. This designing device includes at least one storage device for storing data required for the production of the knit products on the knitting machine, at least one display device for displaying design images for the knit products, and at least one input device for altering the design images. In accordance with the present invention, the designing device further includes means for processing data to be exchanged between the storage, input and display devices, including means for generating at least one knit image presentation and at least one corresponding thread course presentation for display as the design images on the display device, and means for simultaneously correspondingly altering one of the presentations as the other is being altered by using the input device.

A particular advantage of the designing device as described so far is that it is now possible by using the above designing device to utilize either one of the thread course and knit image presentations for the entry and/or alteration of data relating to the elements of the knit product, while the respectively other of such presentations or at least the data describing the same is changed accordingly in a simultaneous or concurrent fashion. Consequently, the designing device of the present invention is suited for use both by style designers and technically oriented users. In this respect, it is particularly advantageous for the processing means to further include means for sending the knit image presentation and the thread course presentation to the display device for simultaneous display thereon. Of course, if so desired, other presentations, such as those that more closely depict the machine operations, can be displayed on the display device as well.

Additional advantages are obtained when the processing means further includes means for sending at least one of the knit image presentation and the thread course presentation of a plurality of sections of the respective knit product to the display device for simultaneous display thereon. Such a simultaneous display may be achieved by resorting to the well-known window display technique. All of such windows are or equal rank during the editing, and they display images that are based on the same instructions or information. The effect of any modification in the thread course presentation on the knit product can be immediately observed in the reality-close knit or loop image presentation or rendition. This facilitates the spotting or recognition of errors or undesired effects. It is also possible in accordance with the present invention for the processing means to further include means for sending at least one of the knit image presentation and the thread course presentation of respective front and rear surfaces of the respective knit product to the display device for simultaneous display thereon.

It is especially advantageous when, in accordance with a further facet of the present invention, the generating means includes means for generating the knit image presentation as a reality-resembling, three-dimensional image of all elements of such a presentation including at least one of at least the loop size, tuck and float, wherein the individual elements, by performing predetermined offsetting and wrap-around around operations, may be tied in into the overall structure of the eventual knit product in directions different from the prevailing direction of the stitches of such a product. This is especially convenient to achieve when the input device includes means for entering and altering, for each needle position of the knit product, the kind, the shape and the size of the loop to be displayed in the knit image presentation. To this, there may be added data describing the kind of yarn(s) to be used in the manufacture of the knit product. In addition, the processing means may further include means for calculating, for forwarding to the generating means, information concerning the shape of the respective loop in dependence on the kind, size and shape of respective adjacent loops and in dependence on the properties of the knitting yarns to be used in the manufacture of the knit product.

Structural designs such as braid, aran etc. have sections in which loops from the typically vertically extending loop columns are wrapped around laterally around the loops of other loop columns. As a result of this deviation from the regular course, forces come into being in the knit product which influence the orientations of the loops. In a currently preferred embodiment of the designing apparatus of the present invention, there are offered to the user several kinds of presentations. For one, the basic structure of the design for the knit product may be kept unaltered in the knit image presentation and just the loops that are wrapped around loops others than those around which they would have been wrapped in their basic positions, being offset either laterally or in the height, are depicted extended to the extent corresponding to the difference between their basic positions and their new wrapped-around positions. However, the knit image presentation may also be, in accordance with the present invention, constructed in a manner that is closer to reality by taking into account the forces that act in the knit product as a result of such loop deviations in that even the loops that are situated in the vicinity of such deviated loops are shortened or lengthened to some extent in response to such forces. Moreover, the user is given the opportunity to change the positions of individual elements, such as loops, tuck or float correspondingly to his or her visual perception for the overall loop or knit image.

For the manufacture of knit products with loops of different magnitudes and yarn thicknesses, these loops can be rendered even in the knit product design in close correspondence to reality both as to the yarn thicknesses and the loop sizes.

Advantageously, the generating means for the thread course presentation includes means for generating respective symbols for all elements of the knit product to be manufactured including at least one of at least the loop size, tuck and float as well as for the needles of the knitting machine and their activities including knitting, not knitting, transferring, taking over, shedding and the like, and the symbol-generating means may preferably further include means for generating symbols for the parameters of the knitting machine including at least one of at least thread-guide movements, carriage movements, product withdrawal, needle bed offset and the like.

A significant design simplification can be achieved when, in accordance with another aspect of the present invention, the processing means further includes means for combining groups of symbols of a thread course presentation into modules, and means for combining groups of loops of a knit image presentation into modules, and when the storing means includes means for storing the modules. Such modules may then be used either at a different location of the knit product, or in a different knit product altogether as a unit. Furthermore, it is proposed that the processing means further include means for inserting at least one of the modules into at least one of the presentations of a basic knit product, including means for tying in the loops of the module into the loop structure of the basic knit product in a manner that is technologically correct. The connection or tying in of the loops of the module in the knit image presentation with those of the basic knit product then corresponds to the actual conditions encountered in the knit product.

The designing device of the present invention may further include means in its processing means for graphically superimposing a plurality of rows of the respective thread course presentation into a single loop row and/or for contracting a plurality of rows of the respective knit image presentation into a single loop row on the display device. By resorting to this expedient, several rows of the knit image presentation can be contracted in such a manner that they occupy, in their vertical dimension, the same amount of space as merely a single row or course of the knit product. As a result, appliqués that would create spatial formations in the knit product can be presented in the knit image presentation appearing on the display device in a manner that is very close to reality. These means offer special advantages in the creation of Jacquard patterns. So, for instance, during the design of a three-color Jacquard knit, the representations of the yarns of the three colors can be contracted into a single row on the display device. Herein, the loops of the Jacquard back side are so arranged behind the Jacquard front side as it would eventually correspond to the actual appearance of the Jacquard knit product. Even in other two-surface knit products, the loops of the underlying surfaces are partially visible when looping on the first or top surface.

If the knit product is to include a skew region, then the latter can be presented on the display device horizontally, in a row-by-row manner corresponding to the knitting progress that is to take place on the knitting machine. In this presentation, the loops that are not being knit in the skew region are extended in their lengths to such an extent as corresponds to the knitting progress prior to the recommencement of their involvement in the knitting process. However, even here, the presentation can be, in accordance with the present invention, so "pushed together" that there results a reality-close presentation in which the loop rows of the skew region extend at an angle to the loop rows or courses of the basic knit structure.

Even Jacquard patterns can be presented in a so-to-speak distended condition in which all of the color knit rows needed for forming a single view row in the final knit product are presented above one another in the vertical direction. To achieve this, the processing means further includes means for graphically separating a single superimposed loop row of the respective thread course presentation into a plurality of constituent rows for display on the displaying device and/or means for graphically separating a single contracted loop row of the respective knit image presentation into a plurality of constituent rows for display on the displaying device.

Considerable additional advantages are obtained when the processing means further includes means for generating multiplicates of the modules for display on the display device and/or means for generating mirror images of the modules for display on the display device. The number of needles per knitting module both in height and in width is arbitrary. The same is also valid about the outer shape of the module.

Any knit module can be formed in two different ways: either as a section of a knit structure in knit image presentation or thread course presentation, or as a separate knit structure that is created in the knit image presentation or in the thread course presentation. Both of these presentations are automatically available for these knit modules. So, a knit module generated in the thread course presentation can be inserted at any time into the knit image presentation of the basic knit structure and can then be seen there in its knit image presentation as well. It is also possible for the knit modules to form the edges of a knit product. The modules may be introduced into the design for the knit product in such a manner as to horizontally or vertically adjoin each other, be offset with respect to one another, or be paced at predetermined distances from each other. There can even be specified the size of the are that is to be filled by a certain module. If the area to be filled does not correspond in one direction or the other to a multiple of the size of such a module, the remaining parts of this area are then filled with fractional parts of this module.

With respect to each of such knit modules, there may be stored in the storage device additional attributes which indicate the conditions of use for such a module. These attributes may include, for instance, the capability of mirroring the module from left to right or from above to below, or the unity of the module, that is the instruction that the module may only be used in the knit product in its entirety. With the aid of these attributes, it can also be prescribed that the module must be knit by itself as the knit product is being knit. Even the machine resolution in which the module must be generated, or the maximum permissible offset of the module can be given as attributes.

The following criteria may be taken into consideration during the insertion of a module into the basic knit structure of a knit product:

When loops are being formed in the same row of the basic knit product and the module, then the loops of the module replace the corresponding loops of the basic knit product. When, on the other hand, loops are being formed in the basic knit product but loops are carried over or skipped in the module, then a carry-over row is inserted into the basic knit structure. When loops are being carried over in the basic knit product but loops are being formed in the knit module, then the loops of the module replace in their region the loops of the next-following row of the basic knit product. In the event that loops are being carried over in the same row both in the basic knit product and in the module, then the offsetting and transferring movements are being conducted in a predetermined rank order. When loops are thrown off in a module knit row, then a throw-away row is introduced into the basic knit product, provided that a throw-away row does not already exist in the basic knit structure. Elevation references can be indicated both in the basic knit structure and in the module at which the knitting operation must not be altered by the module integration routines.

It is especially advantageous when the processing means further includes means for inserting at least one module of any type into at least one of the presentations of a basic textile product of any type. In this context, the user may give instructions about how the automatic control of the operation is to react at the region of the module to the different knitting process control cards. Such instructions may be defined individually for each needle that lies immediately within or without the module contour. So, it can be preordained in the course of which knitting operation type—loop, tuck, no-loop—of the respective needle at the border region the modification of the knit structure is to take place. Besides, it can be specified how the basic knit structure of the border region is to be modified in dependence on the operation type of the needle at that region. To this end, it is proposed for the processing means to further include means for defining border modules between at least one of the presentations of the module and at least the corresponding one of the presentations of the basic knit product. Such a border or transition module may be situated directly at the boundary between the module and the basic knit structure; however, it may even be placed, when necessitated by knitting operation consideration, at a distance from this boundary.

The designing device may further include a Jacquard generator for the design of the connecting structure of the Jacquard front side with the Jacquard rear side of the knit product in at least one of the knit image and thread course presentations. The colors of the visible side can be predetermined either in the knit image or thread course presentation, or as a loop-rastered color image. All Jacquard connecting structures between the visible side and the back side, which embody the state of the art in the knitting technology, may already be contained in the storage device of the designing apparatus and be presented to the user in a menu form for utilization. Once the user has selected a connecting structure from the respective menu, the Jacquard generator automatically generates the desired connecting structure, depending on the visible Jacquard side. However, the user may also use the Jacquard generator to define his or her own connecting structure, and to store the same for future reference.

After the knitting instructions have been entered to alter either the knit image presentation or the thread course presentation, the processing means calculates from such data the control data for controlling the operation of the knitting machine. However, the translation of the knitting instructions into such control data is sometimes not unique. So, for instance, there may be several possibilities of implementation. Therefore, the designing device may, in accordance with another feature of the present invention, include interactive means for influencing the translation of the design images of the through the input device knit product into control data for the knitting machine. In this manner, it is possible to manually choose one of several translation possibilities of the design images into control data for controlling the operation of the knitting machine. Moreover, the storage device may advantageously include storage areas for storing frequently used translation algorithms between the design images and control data for the knitting machine as entered by the interactive means. This has the advantage that, when a designer of a new product encounters a certain translation problem, he or she may resort to the use of an already available algorithm, so that the latter need not be entered again. This interactive means may also be so set up that the user can determine for all detected translation problems if his or her interactively made selections and/or changes are to be automatically used throughout the particular knit product, or generally for all knit products to be manufactured.

The present invention is also directed to a method of designing knit products to be manufactured on a knitting machine, which method comprises the steps of generating at least one knit image presentation and at least one corresponding thread course presentation of the respective knit product, displaying such presentations, and simultaneously correspondingly altering one of the presentations when and as the other is being altered. There are advantageously also provided the further steps of converting the respective one of the knit image presentation and the thread course presentation into design data for the knit product, and storing such design data for shared use in both of the presentations. This means that a common set of data is generated and stored for both of such presentations of the product to be manufactured, which facilitates the simultaneous transfer of the alterations in one of the presentations into the other.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a loop image presentation of a loop product;

FIG. 5 is a loop image presentation of a border region of a loop product;

FIG. 7 is a loop image presentation of a knit product containing loops of different dimensions and yarn thicknesses;

FIGS. 8*a* and 8*b* are two different loop image presentations of a knit product with a wave appliqué;

DETAILED DESCRIPTION OF THE PREFERRED EMBODIMENT

Figure 1:
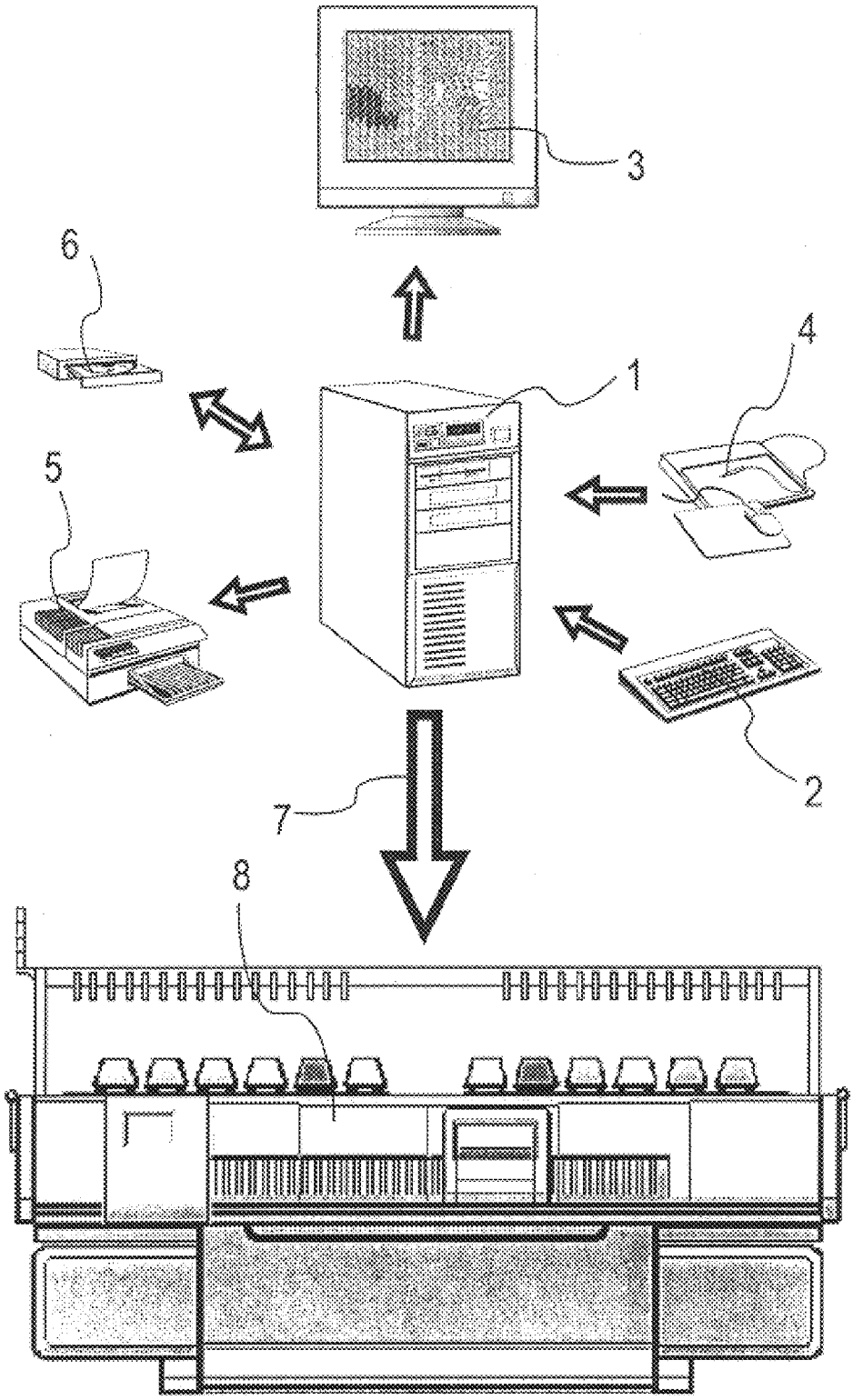
FIG. 1 is a diagrammatic view showing, in principle, a designing device embodying the present invention, together with a flat knitting machine.

Referring now to the drawing in detail, and first to FIG. 1 thereof, it may be seen that it depicts one possible configuration of a device for designing products according to the present invention. Such products include a great number of adjacent and/or interengaging loops and are produced by machinery using a multitude of cooperating needles, so that they will be referred to throughout, sometimes interchangeably but typically without distinction, as loop or knit products regardless of which precise technique and/or machinery (knitting, flatbed, doubleknit, frame, Jacquard-controlled, etc. whether using a continuous thread or a plurality of threads) is being employed to produce the same. The designing device mentioned above includes a computer 1, a monitor 3 to serve as a display device, as well as a keyboard 2 and a graphic tablet 4 to serve as input devices. Furthermore, an external mass storage device 6, as well as a printer 5 to serves as an additional display device, are connected with the computer 1. The control data that are generated by this designing device are supplied, in the illustrated example, to a flat knitting machine 8, as indicated by an arrow 7.

Figure 2:
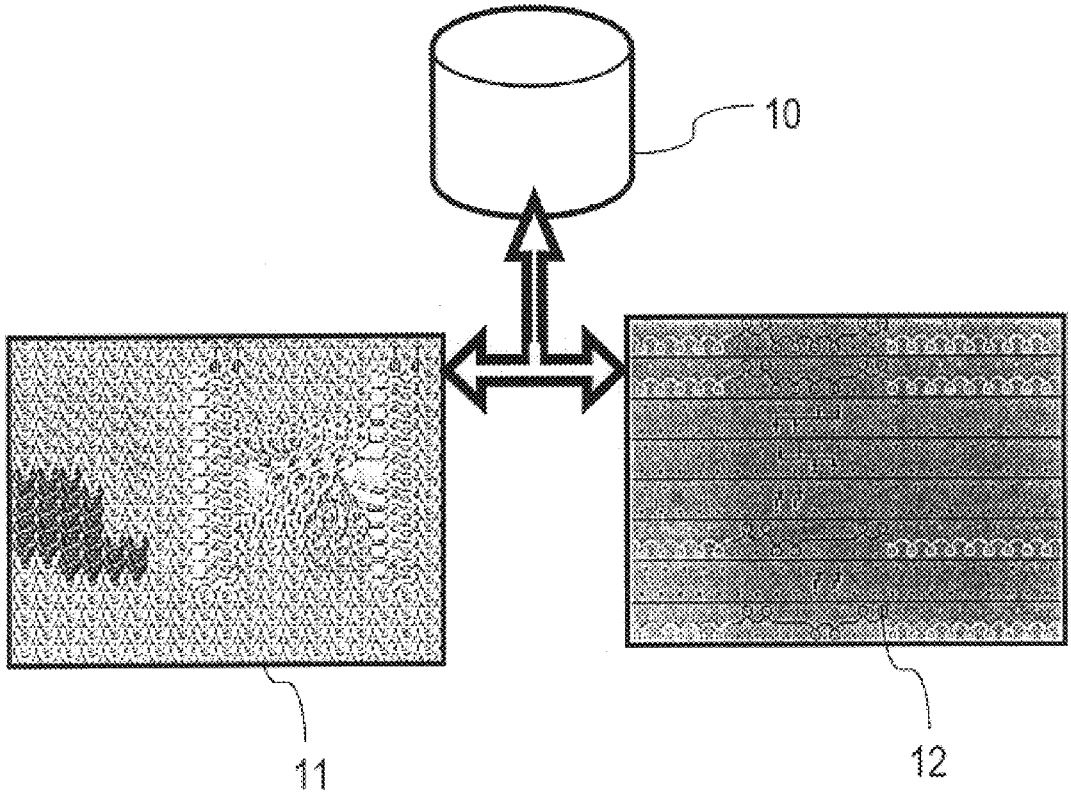
FIG. 2 is another diagrammatic view presenting, in principle, a data storage unit as well as a loop image presentation and a thread course presentation of a knit section.

FIG. 2 shows two different design presentations that can be displayed on the display device 3 of the designing system or device. These presentations are a loop image presentation 11 and a thread course presentation 12 of a loop product. The two presentations 11 and 12 are generated from data stored in a shared storage device 10 that is indicated in the drawing only in a simplified, diagrammatic form. The very same data set is altered on the storage device 10 during the editing and alteration of any one of the two presentations 11 and 12 as well. In this manner, it is possible to achieve, when one of these two presentations is altered, a simultaneous corresponding change in the respective other of these presentations.

Figure 3:
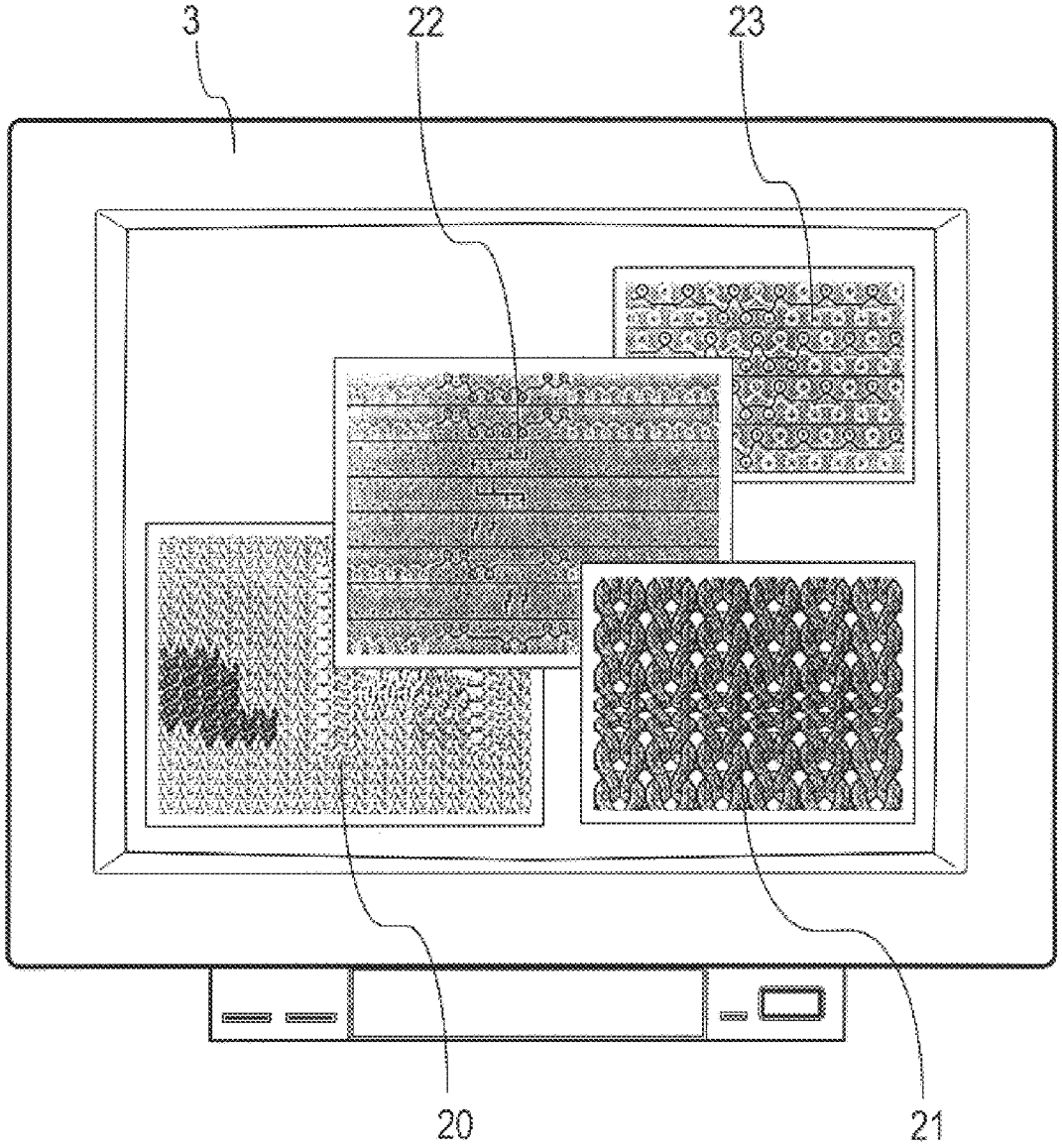
FIG. 3 is a front elevational view of a monitor with windows containing various loop image and thread course presentations.

In FIG. 3, the monitor 3 shown in general terms in FIG. 1 is presented at a larger scale. Several display windows 20, 21, 22 and 23 are shown to be displayed on the monitor screen. Of these windows 10 to 23, the windows 20 and 21 contain loop image presentations, while the remaining windows 22 and 23 contain thread course presentations. By resorting to this window technique, it is thus possible to simultaneously make visible loop image presentations as well as thread course presentations of several sections of the loop product.

FIG. 4 illustrates a section of a loop image presentation, from which the closeness-to-reality of this presentation type is evident. There are shown many and particularly identified several elements of the product, such as a plain stitch or loop 30, a plain loop 31 pulled up or extending over two rows or courses of the product, a plain loop 32 that is hanged around one column to the left, and a loop 33 that is hanged around one column to the right. A further loop identified as 34 is a plain loop or stitch that is pulled up or extends over three rows or courses of the knit product. All of the loops are shown in three dimensions and they can, of course, also be rendered in colors; advantageously, the colors of the threads in the rendition appearing on the screen correspond to the colors of the threads or yarns used to make the actual product.

FIG. 5 reveals a loop image presentation of a boundary region of a loop or knit product. Two plain stitches 35 and 36 are connected with one another by a connecting loop 37. In this manner, the presentation of FIG. 5 corresponds exactly to the actual thread course in the corresponding knit product piece.

Figure 6A:
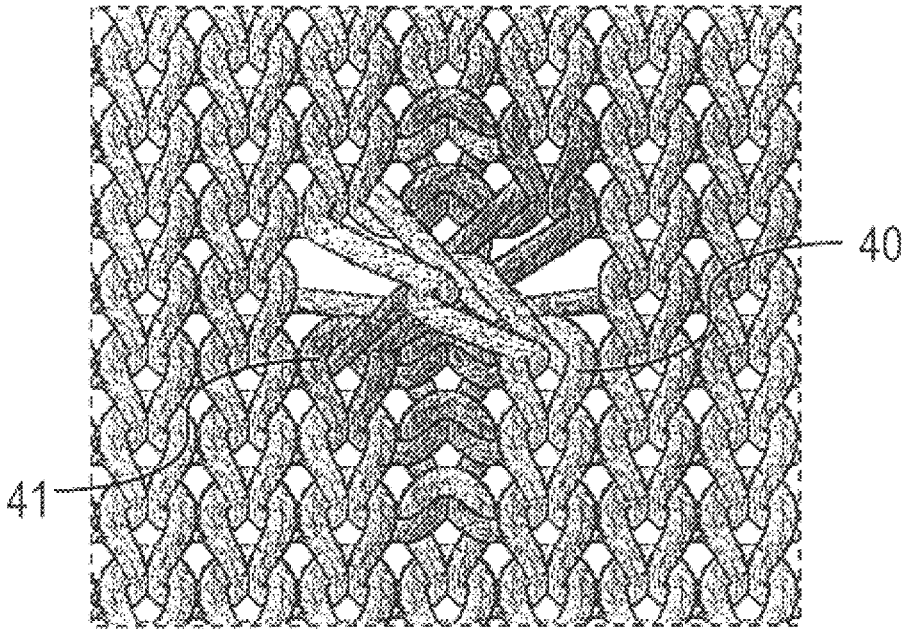
FIGS. 6*a* and 6*b* are two different loop image presentations of a loop cross-over area of a knit product.
Figure 6B:
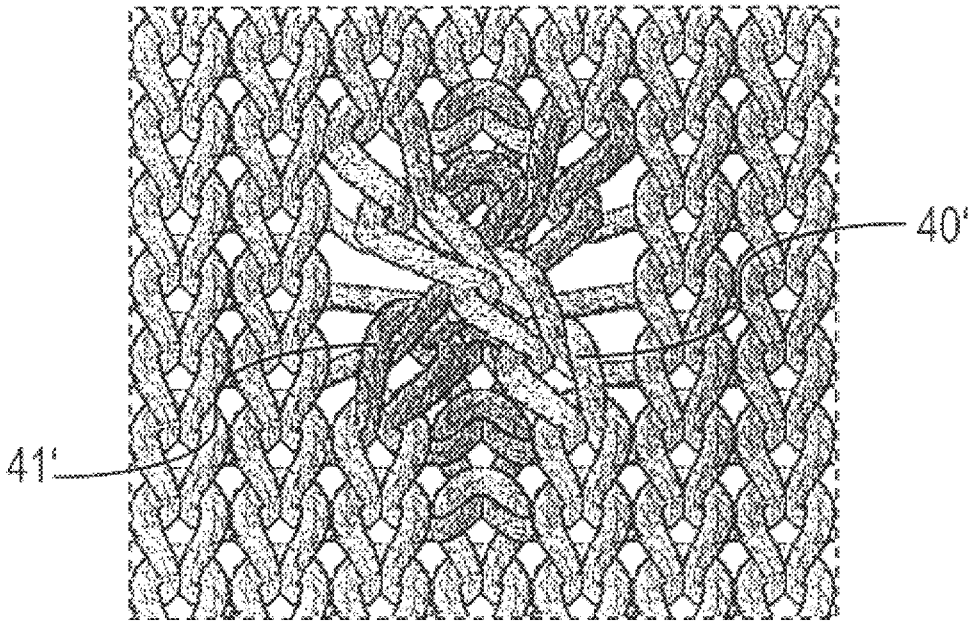

FIG. 5 reveals a loop image presentation of a loop product with a loop cross-over, in two different presentation modes. In FIG. 6*a*, only the loops that actually cross over are shown at an angle to the vertical, whereas all other loops, especially loops 40 and 41 that are situated directly below the mutually crossing loops, are drawn completely unchanged. In contradistinction to this, the conditions are shown more realistically in FIG. 6*b*. Herein not only the loops or stitches that actually cross one another extend at respective angles to the vertical, but also the adjoining loops or stitches, for instance the loops 40' and 41', as it occurs in the actual knit product piece as a result of the forces acting on the various loops at the region of the loop cross-over.

In FIG. 7, there is shown a loop image presentation of a knit product with loops of different magnitudes of yarns with different thicknesses. Even here, the transition between relatively small plain stitches 45 made of relatively thin yarn and relatively large stitches 46 made of relatively thick yarns are shown in a manner close to the real-life conditions.

FIG. 8 relates to a loop image presentation of a knit product including a wave appliqué 51 indicated by a darker color. In FIG. 8*a*, the two knit rows or courses of the wave appliqué 51 are shown in their normal sizes, while he loops 52 preceding and succeeding the wave appliqué 51 are shown in an extended form. Hence, FIG. 8*a* is a rather theoretical presentation which, however, shows the wave appliqué 51 proper very well. In contrast, a presentation that is closer to reality has been chosen for FIG. 8*b*. The two loop courses of the wave appliqué 51' are contracted here and the remaining loops 50' are shown in their original dimensions and not extended. In order to permit such kinds of presentations, the designing device or system of the present invention includes devices for graphical parting and superimposition of loops and loop rows.

Figure 9A:
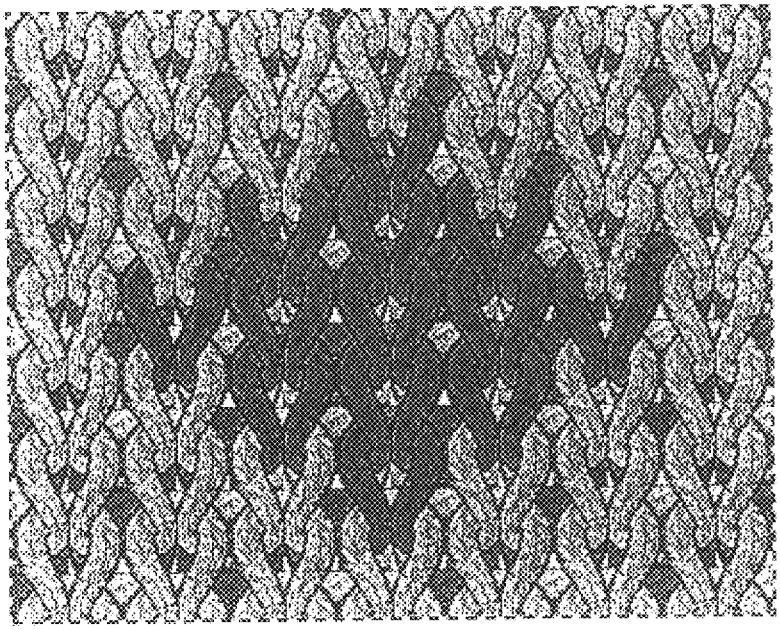
FIGS. 9*a* and 9*b* are front and rear views of a two-color Jacquard knit product, in loop image presentations.
Figure 9B:
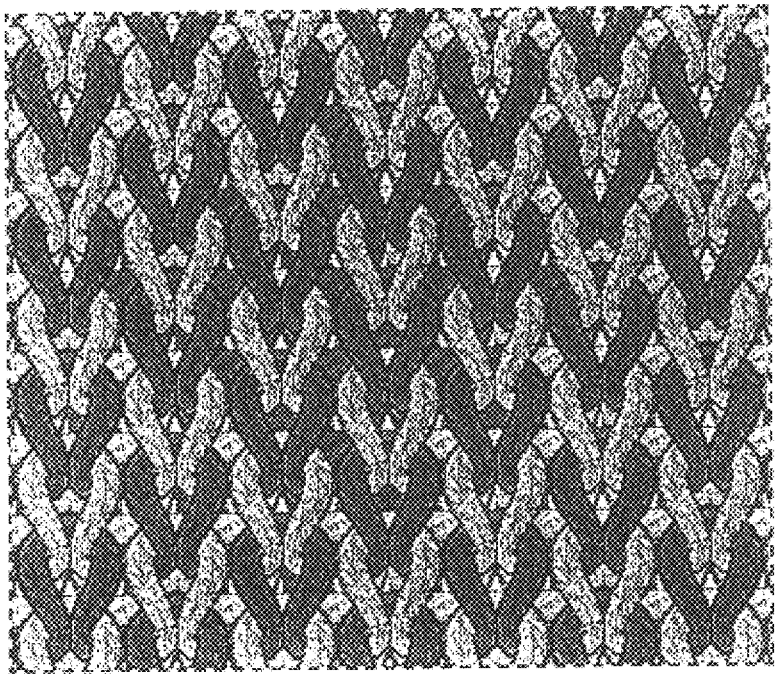

FIG. 9*a* shows a front side of a two-color Jacquard knit product in a loop image presentation, and FIG. 9*b* a rear side of the corresponding loop product. It is possible to show both of these presentations simultaneously on the screen of the monitor 3.

Figure 10A:
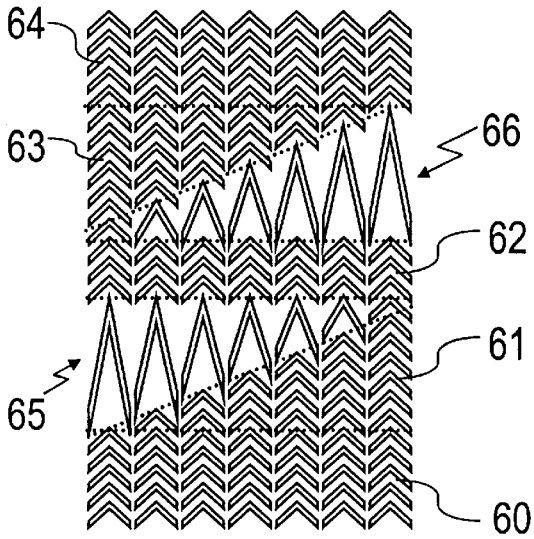
FIGS. 10*a* and 10*b* are two different possibilities of presenting a skew region of a knit product.
Figure 10B:
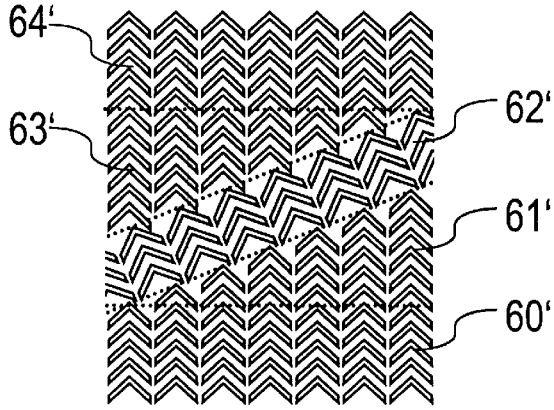

In FIG. 10, there are shown two different kinds of presentation of a skew region, indicated by loop symbols. In FIG. 10*a*, two skew regions 61 and 63 are shown to extend horizontally, correspondingly to the way they are actually produced on the knitting machine. Region 60 is a loop region immediately preceding the first skew region 62, whereas region 64 is the substantially triangular region immediately succeeding the second skew region 63. The two skew regions 61 and 63 are separated from each other by an intervening region 62 exhibiting a full knit product width. Respective loops 65 and 66 situated in the skew regions 61 and 63, which hang in the course of the manufacture on needles that temporarily do not participate in the knitting process of the knitting machine while the overall skew region is being formed, are shown to be extended in this particular presentation. The respective loop extensions stretch over as many rows as the number of knitting cycles during which the associated needles do not participate in the knitting process. In the reality-closer presentation of FIG. 10*b*, the loops of the intervening region 62' extend at a slant, whereas all of the loops in the skew regions 61' and 63' are shown in their unexpanded sizes.

Figure 11:
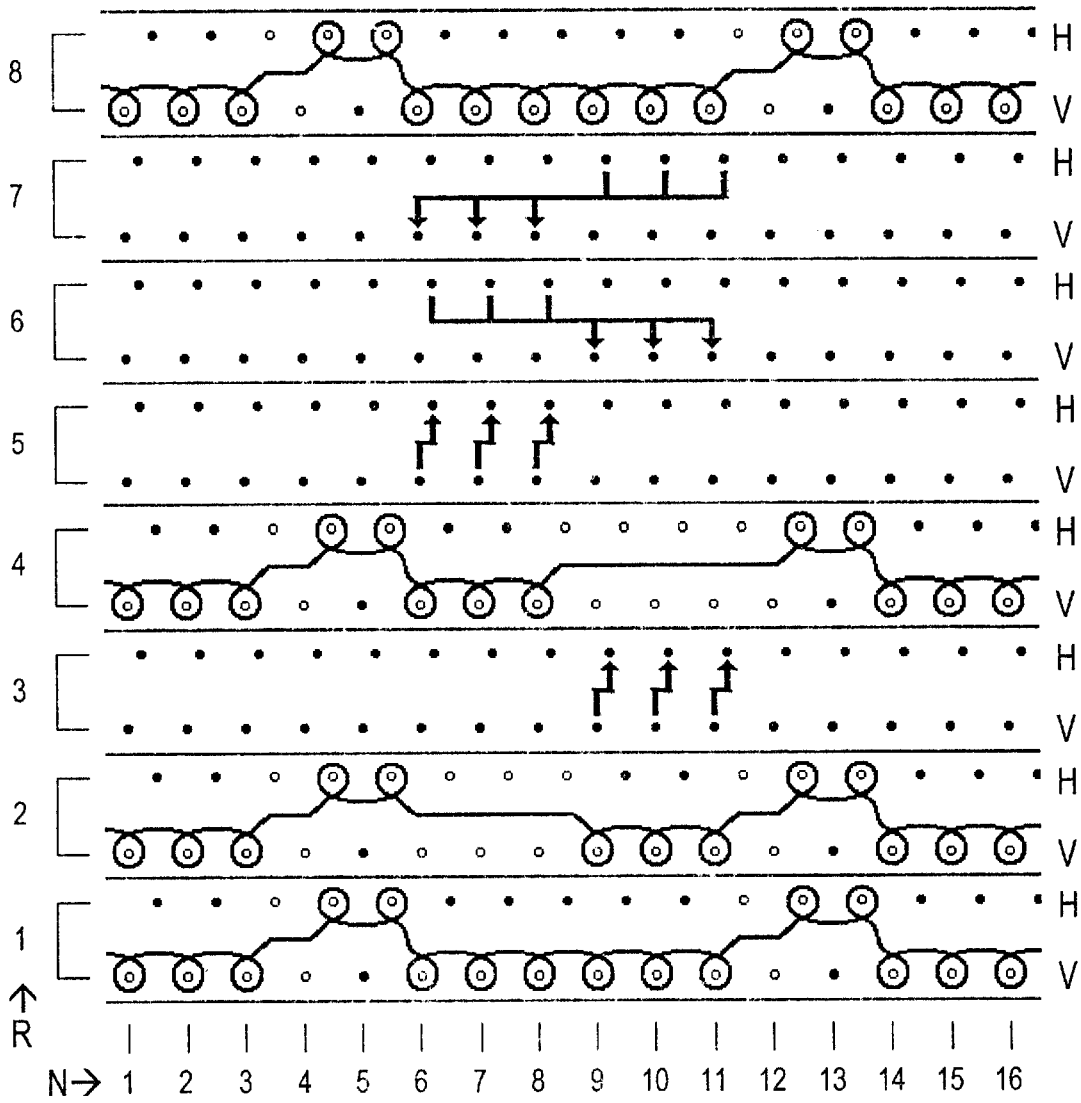
FIG. 11 is a thread course presentation of a braided knit region.

FIG. 11 shows a first thread course presentation of a 2-by-3 braid knit product. Respective rows 1, 2, 4 and 8 contain knitting instructions for loop formation in a front and a rear needle bed V and H of a flat knitting machine, respectively. In rows 3 and 5, there are provided loop-around instructions from the front needle bed V to the rear needle bed H for loops associated with needles 9, 10 and 11, or 6, 7 and 8, respectively. Rows 6 and 7 contain needle bed offset and loop-around instructions. Thus, in row 6, the loops of the needles 6, 7 and 8 from the read needle bed H are shifted by three columns or loops to the right and transferred to or hung around the corresponding needles of the front needle bed V. In the row 7, there is indicated the looping of the loops of the needles 9, 10 and 11 from the rear needle bed H around the corresponding needles of the front bed V as being shifted to the left by three columns or loops. In contrast to the loop image presentation, the thread course presentation is no longer close to what the knit product would look like in reality; rather, it is produced by utilizing respective symbols. Hence, the thread course presentation corresponds more closely to the operations that the respective knitting machine must perform during the production of the respective knit product.

Figure 12A:
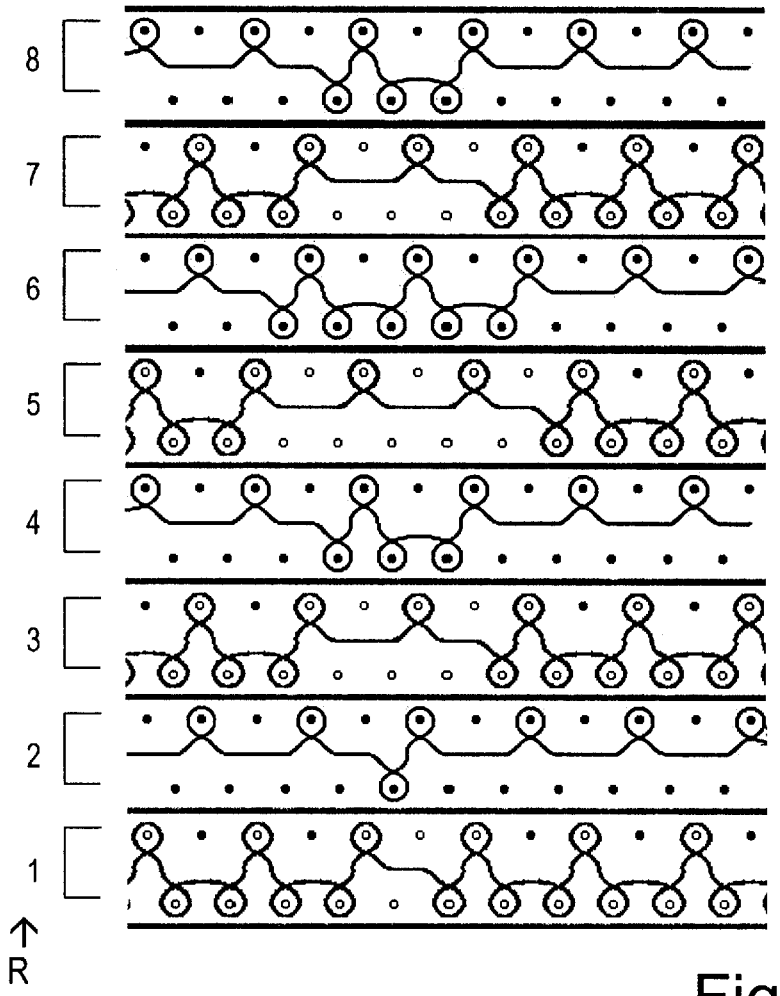
FIGS. 12*a* and 12*b* are thread course presentations of a two-color Jacquard knit product in exploded and superimposed forms.
Figure 12B:
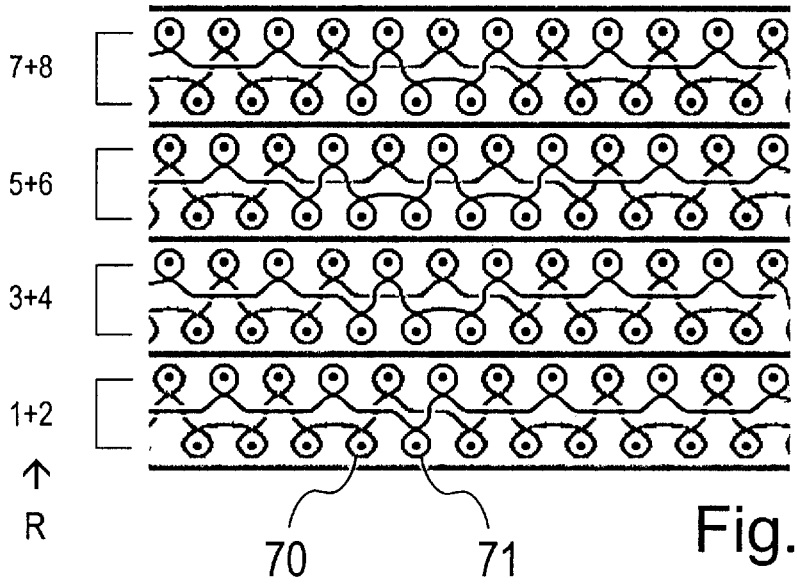

In FIG. 12, there are presented two possibilities of the thread course presentation of a two-color Jacquard knit product. FIG. 12*a* shows a separate knitting row for each of the two colors of the Jacquard knit product, wherein the rows 1, 3, 5 and 7 are associated with one of these colors whereas the rows 2, 4, 6 and 8 correspond to the other color. In FIG. 12*b*, the respective associated ones of the aforementioned rows are superimposed and thus form respective appearance rows that correspond to the knit rows as they actually appear in the finished knit product. Herein, respective loops 70 are the loops that are of one of the colors, whereas loops 71 are loops that are formed in the other color.

Figure 13A:
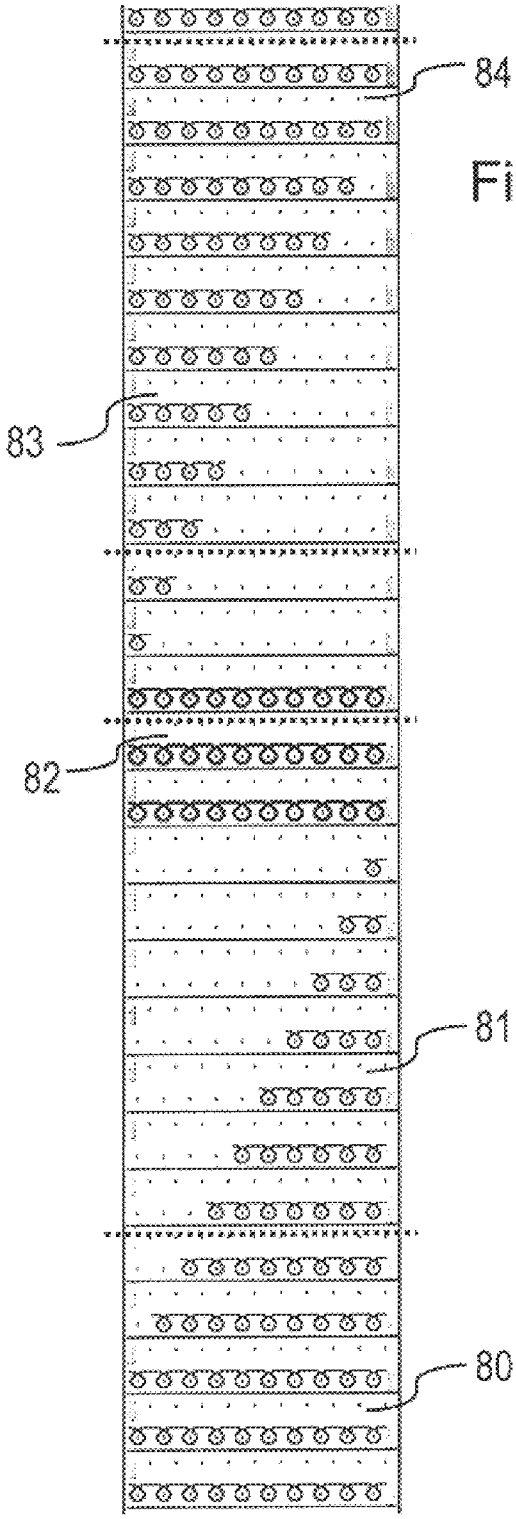
FIGS. 13*a* and 13*b* are thread course presentations of a skew region of a knit product in exploded and contracted forms.
Figure 13B:
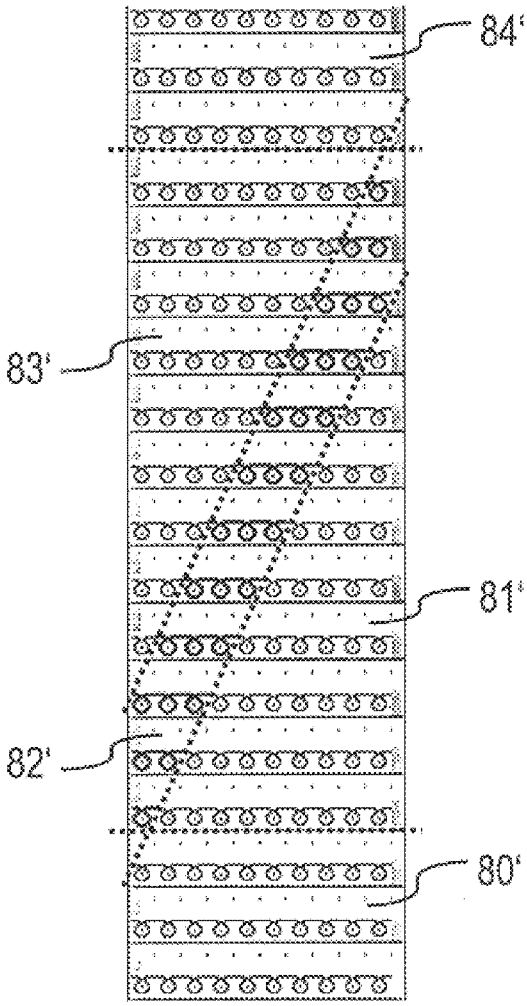

FIG. 13 shows two possibilities of the thread course presentation of skew regions of a knit product piece. In FIG. 13*a*, a first knit product region 80 extending over a full knit product width is adjoined by a first skew region 81 in which an increasing number of needles ceases to participate in the knitting process. Then, there comes a knit product region 82 extending over the entire width of the knit product, before there is encountered a further skew region 83 within which an increasing number of needles commences its participation in the knitting process, until the entire knit product width is reached again in a region 84. The presentation shown in FIG. 13*b* is closer to reality, though. Here, the loops of the intermediate region 82' extend at a slant with respect to the knitting progress direction, akin to how they subsequently also behave in the finished knit product. The remaining regions 80', 81', 83' and 84' remain unchanged in their presentation with respect to their similarly designated counterparts in FIG. 13*a*.

Figure 14A:
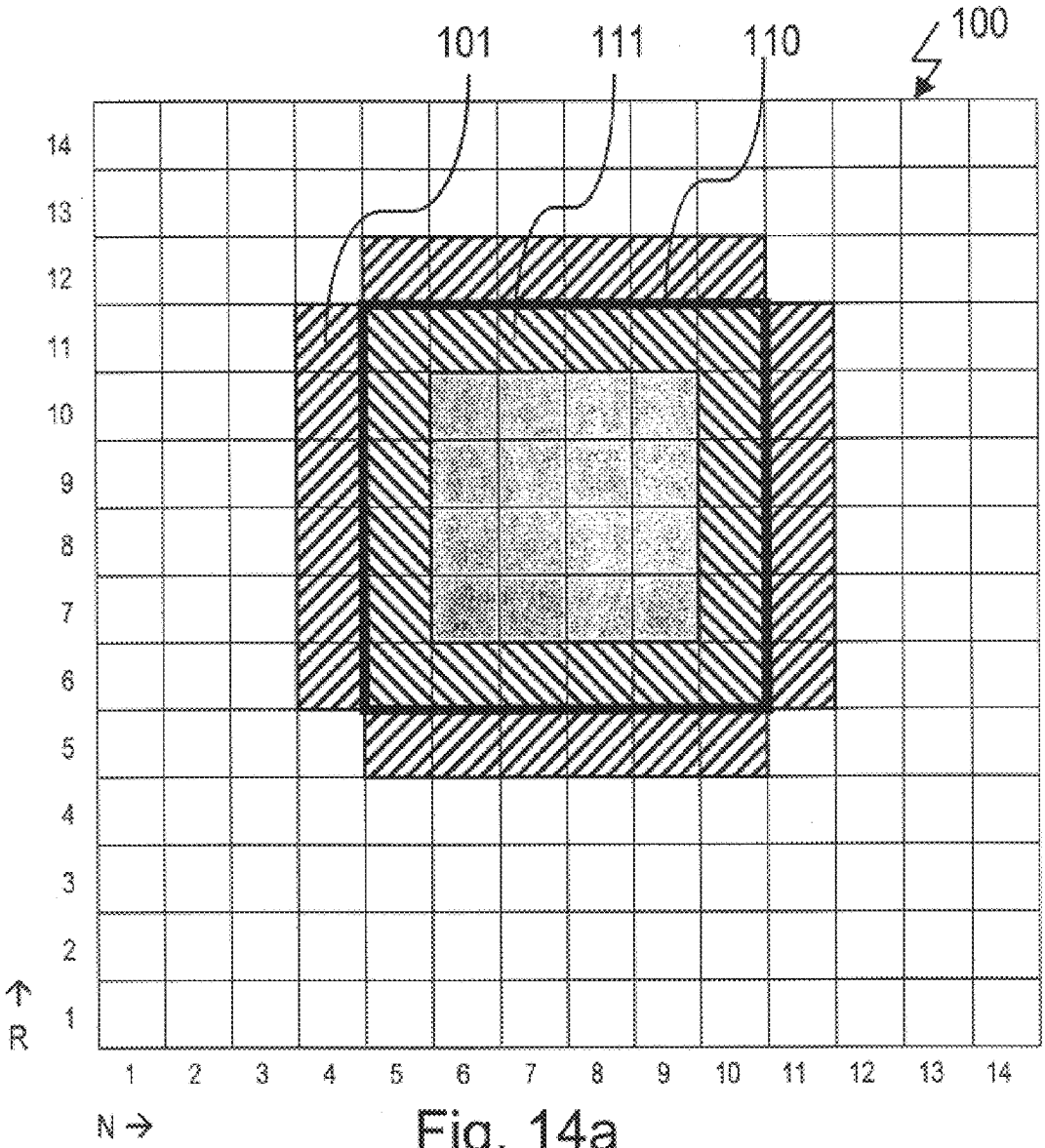
FIGS. 14*a* to 14*c* are diagrammatic representations of a knit product module with indications of boundary regions of the knit product module and of the surrounding basic knit product.
Figure 14B:
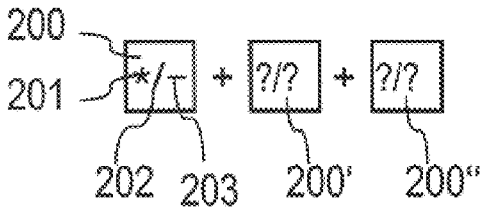
Figure 14C:
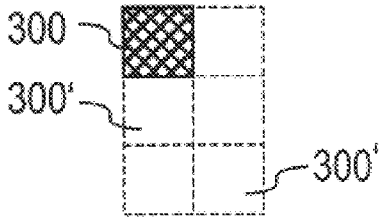
Figure 15:
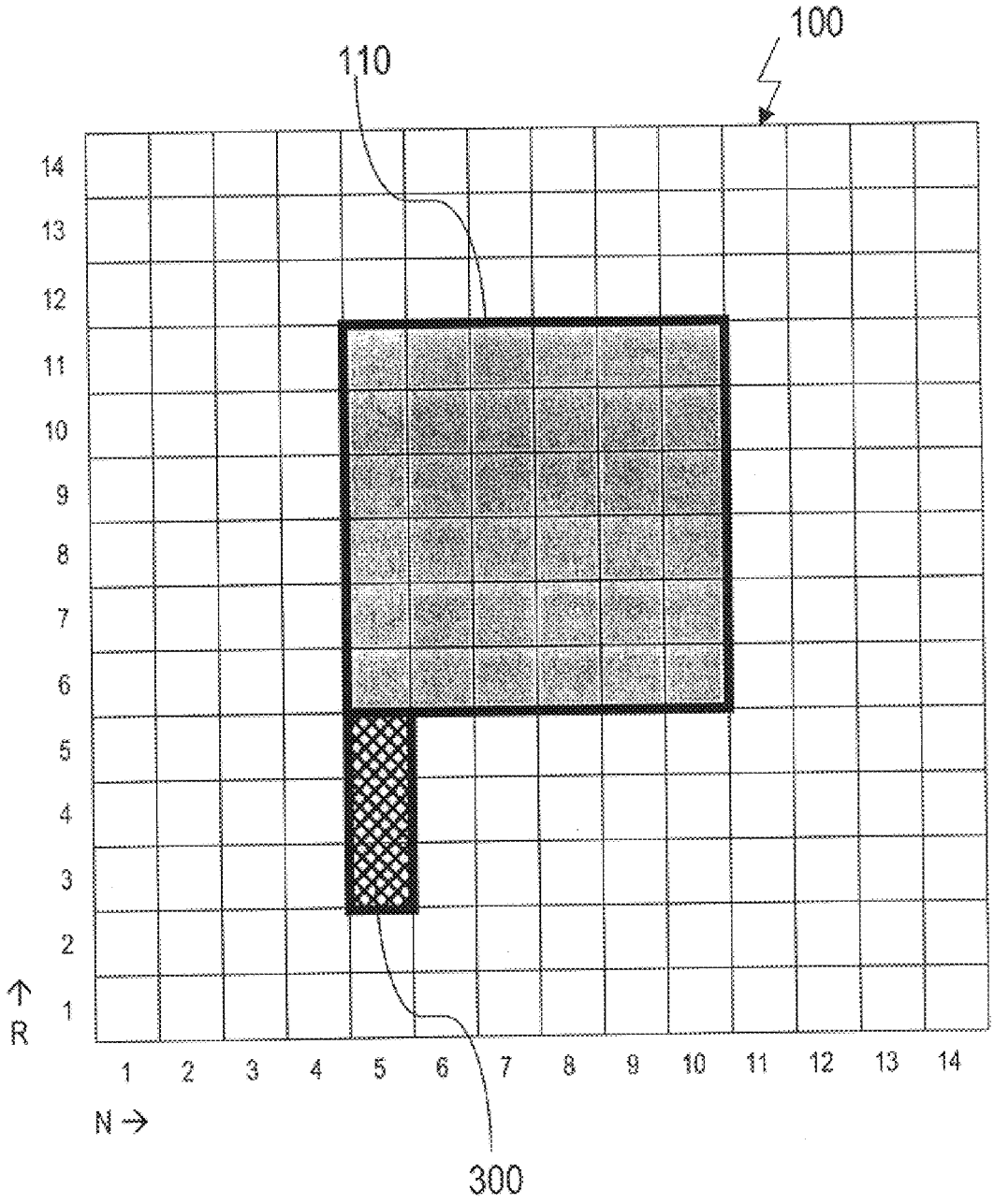
FIG. 15 is a diagrammatic representation of a knit product module with a boundary module inserted in a basic knit product.

FIG. 14*a* focuses on the insertion or incorporation of a knit module 110 that is delimited by a thick black line into a basic knit product 100. Respective boundary loops of the knit module 110 relative to the basic knit product 100 are denoted by the reference numeral 111, whereas the boundary loops of the basic knit product 100 with regard to the knit module 110 are designated as 101. For the incorporation or tying-in of the knit module 110 into the basic knit product 100, it is possibly necessary to make some advance changes in these boundary loops 101 and/or 111 to assure that the knit module 110 is correctly inserted and tied in into the basic knit product 100. In FIG. 14*b*, there is presented a stylized templet 200 for an arbitrary boundary loop 101 or 111. Here, the symbol 201 characterizes the operation of a needle on a front needle bed V, whereas the symbol 203 is indicative of the operation of a needle located on the rear needle bed H. An inclined slash 202 serves merely as a separation symbol between the symbols 201 and 203 for the front and read needle beds V and H, respectively. However, FIG. 14*b* contains not only the instructions for a boundary loop 200, but also, in a logical AND operation coupling, even the instructions for the respective adjoining or neighboring needles and/or loops 200' and 200". In FIG. 14*c*, there is shown an entire boundary module 300 which, in the illustrated example, consists of six needles or loops 300". Depending on the pattern of the knit module 10 and that of the basic knit product 100, such a boundary module may stretch over a greater or a lesser number of needles. This is indicated in FIG. 15. In there, the knit module 110 has been already incorporated into the basic knit product 100 . The boundary needle 5/5 of the basic knit product 100 needs an entire boundary module 300, which modifies the basic knit pattern, in order to be able to correctly tie-in the knit module 110 into the basic knit product 100. The module 300 extends over three needles 5/5, 4/5 and 3/5.

Figure 16:
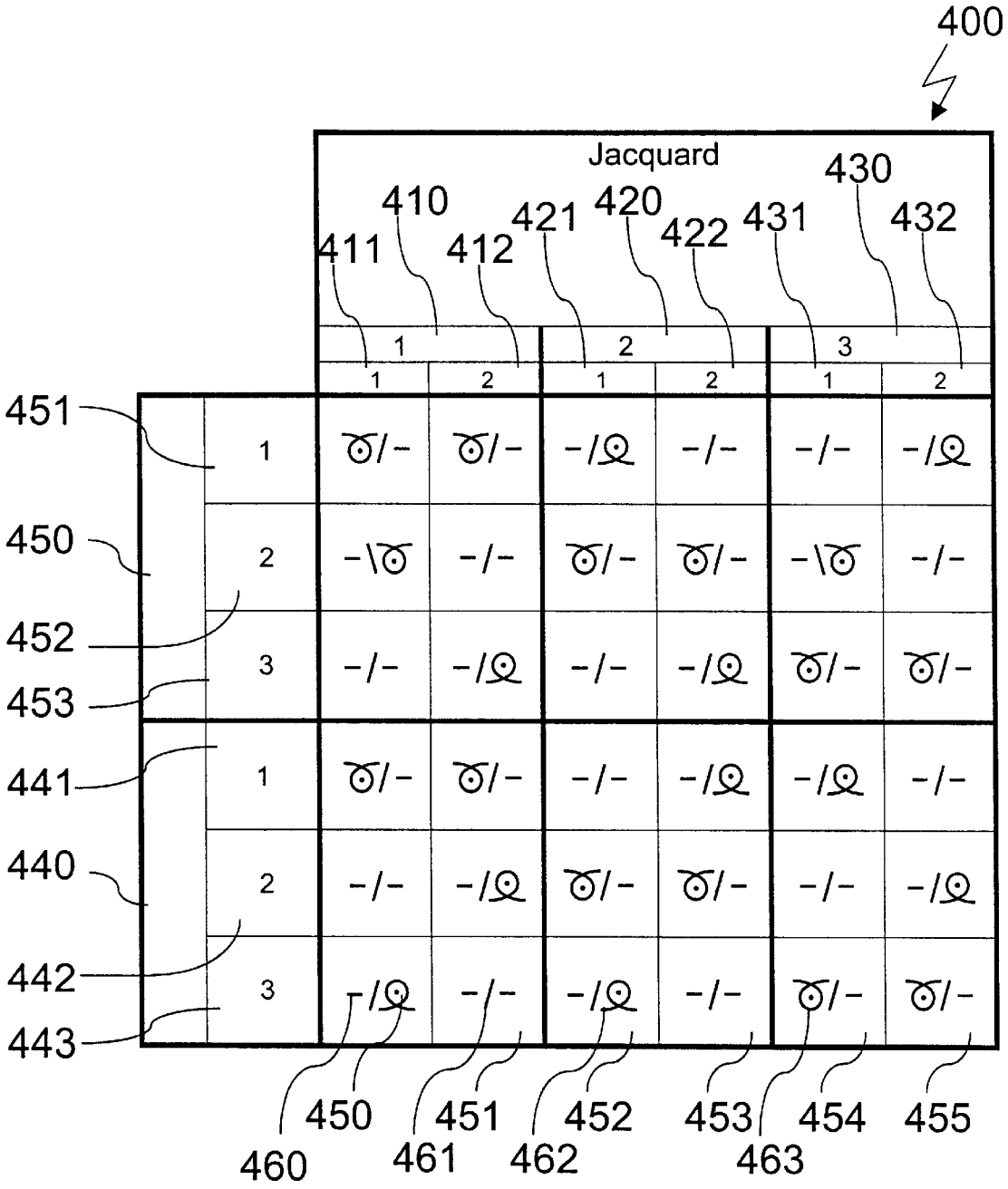
FIG. 16 is a diagrammatic representation of an input mask of a Jacquard generator.

FIG. 16 shows an input mask or templet 400 of a Jacquard generator, by means of which a three-color Jacquard knit product can be designed. Respective columns 410, 420 and 430 of the mask 400 are respectively associated with the three colors. The pattern that had been chosen here for each of the three colors extends over two needles in width, for which reason each of the respective columns 410, 420 and 430 are subdivided again into two sub-columns 411 and 412; 421 and 422, and 431 and 432, respectively. Respective rows 440 and 450 correspond to the respective appearance rows of the Jacquard pattern. These two rows 440 and 450 are repeated again and again over the height of the knit product. Each of the rows 440 and 450 is subdivided once more, this time in three sub-rows 441 to 443 and 451 to 453, respectively corresponding to the three colors of the knitting threads being used. In the rectangular boxes obtained as a result of this fine subdivision of the columns 410, 420 and 430 and of the rows 440 and 450, which rectangles correspond to respective needle positions, it is indicated for each needle of the front and rear needle bed V and H whether or not a loop is to be produced. The instructions for the front and rear needle beds V and H are separated from each other in each instance by a forward slash 461. So, for instance, a horizontal dash 460 in the last sub-row 443 in the first sub-column 411 is indicative of the instruction for the corresponding needle of the front needle bed V not to operate. However, a loop 450 is produced on the rear needle bed H at the same needle position (443/411). At the next adjacent needle position (443/412), neither the front nor the rear needle knits. At the following adjacent needle position (443/413), a loop 462 is formed once more on the read needle bed H; two positions later (443/415) another loop 463 is formed, this time on the front needle bed V. With the aid of this mask or templet, even very complex or intricate Jacquard patterns can be entered and a corresponding loop image presentation or thread course presentation may be displayed on the display device 3 on its basis.

Figure 17A:
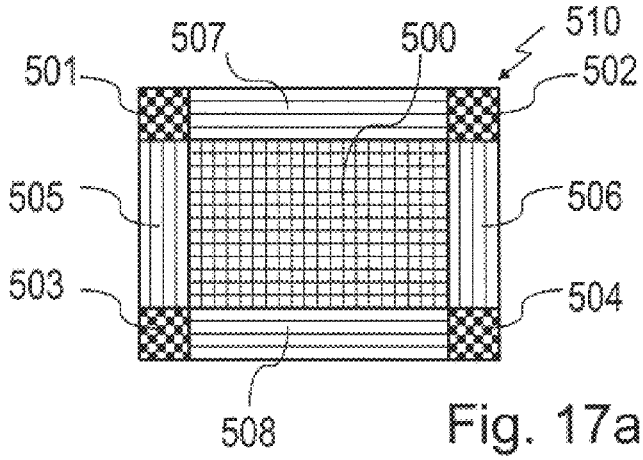
FIGS. 17*a* and 17*b* are diagrammatic presentations of a knit product composed of several regions, in the original size and in an expanded size.
Figure 17B:
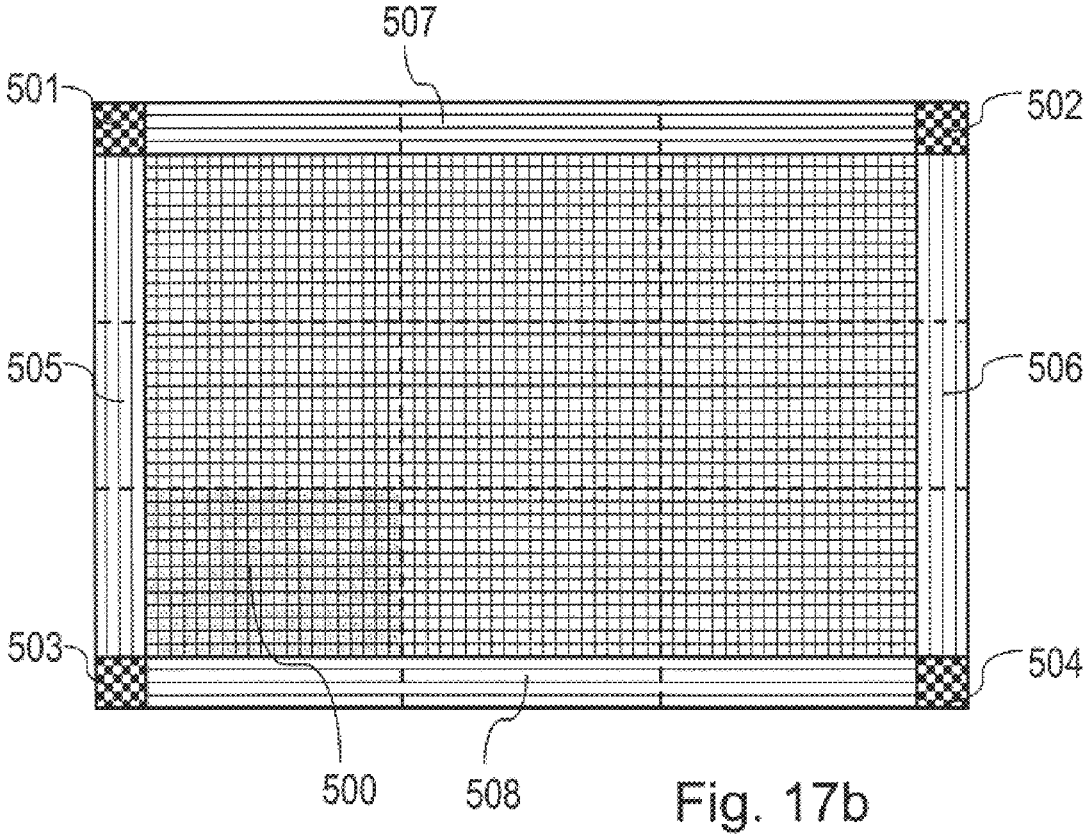

A knit module 510 is shown in FIG. 17*a* of the drawing; this module 510 is composed of several components, namely a central area 500, edge areas 505, 506, 507 and 508, and comer areas 501, 502, 503 and 504. The knit module 510 is especially suited for stretching, that is its expansion in a knit product piece as indicated in FIG. 17*b*. To this end, the central area 500 is duplicated or multiplicated as many times as needed to cover the desired region, and the edge areas 505, 506, 507 and 508 are extended correspondingly. The corner areas 501, 502, 503 and 504 remain unaltered, but are shifted in positions accordingly.

It will be understood that each of the elements described above, or two or more together, may also find a useful application in other types of constructions differing from the type described above.

While the present invention has been described and illustrated herein as embodied in a specific construction of a device for designing and visualizing loop or knit products, it is not limited to the details of this particular construction, since various modifications and structural changes may be made without departing from the spirit of the present invention. So, for instance, other data, instructions or commands that are relevant to the production of a knit product of any imaginable shape and/or pattern may be entered into and processed by the system. Moreover, the designing device of the present invention is suited not only for the design of articles of apparel, but also for the design of technical knits.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

What is claimed is:

1. A device for designing knit products to be manufactured on a knitting machine, comprising at least one storage device for storing data required for the production of the knit products on the knitting machine; at least one display device for displaying design images for the knit products; at least one input device for altering the design images; and means for processing data to be exchanged between said storage, input and display devices, including means for generating at least one knit image presentation and at least one corresponding thread course presentation for display as said design images on said display device, and means for simultaneously correspondingly altering one of said presentations as the other is being altered by using said input device.

2. The designing device as defined in claim 1, wherein said processing means further includes means for sending said knit image presentation and said thread course presentation to said display device for simultaneous display thereon.

3. The designing device as defined in claim 1, wherein said processing means further includes means for sending at least one of said knit image presentation and said thread course presentation of a plurality of sections of the respective knit product to said display device for simultaneous display thereon.

4. The designing device as defined in claim 1, wherein said processing means further includes means for sending at least one of said knit image presentation and said thread course presentation of respective front and rear surfaces of the respective knit product to said display device for simultaneous display thereon.

5. The designing device as defined in claim 1, wherein said generating means includes means for generating said knit image presentation as a reality-resembling, three-dimensional image of all elements of such a presentation including at least one of at least a loop size, tuck and float.

6. The designing device as defined in claim 1, wherein said input device includes means for entering and altering, for each needle position of the knit product, a kind, a shape and a size of the loop to be displayed in the knit image presentation.

7. The designing device as defined in claim 1, wherein said processing means further includes means for calculating for forwarding to said generating means information concerning the shape of the respective loop in dependence on the kind, size and shape of respective adjacent loops and in dependence on the properties of the knitting yarns to be used in the manufacture of the knit product.

8. The designing device as defined in claim 1, wherein said generating means for said thread course presentation includes means for generating respective symbols for all elements of the knit product to be manufactured including at least one of at least the loop size, tuck and float as well as for the needles of the knitting machine and their activities including knitting, not knitting, transferring, taking over, shedding and the like.

9. The designing device as defined in claim 8, wherein said symbol-generating means further includes means for generating symbols for the parameters of the knitting machine including at least one of at least thread-guide movements, carriage movements, product withdrawal, needle bed offset and the like.

10. The designing device as defined in claim 1, wherein said processing means further includes means for superimposing a plurality of rows of the respective thread course presentation into a single loop row.

11. The designing device as defined in claim 1, wherein said processing means further includes means for contracting a plurality of rows of the respective knit image presentation into a single loop row.

12. The designing device as defined in claim 1, wherein said processing means further includes means for graphically separating a single superimposed loop row of the respective thread course presentation into a plurality of constituent rows for display on said displaying device.

13. The designing device as defined in claim 1, wherein said processing means further includes means for graphically separating a single contracted loop row of the respective knit image presentation into a plurality of constituent rows for display on said displaying device.

14. The designing device as defined in claim 1, wherein said processing means further includes means for combining groups of symbols of a thread course presentation into modules, and means for combining groups of loops of a knit image presentation into modules; and wherein said storing means includes means for storing said modules.

15. The designing device as defined in claim 14, wherein said processing means further includes means for inserting at least one of said modules into at least one of said presentations of a basic knit product, including means for tying in the loops of said module into the loop structure of said basic knit product in a manner that is technologically correct.

16. The designing device as defined in claim 14, wherein said processing means further includes means for inserting at least one module of any type into at least one of said presentations of a basic textile product of any type.

17. The designing device as defined in claim 14, wherein said processing means further includes means for defining border modules between at least one of said presentations of said module and at least the corresponding one of said presentations of said basic knit product.

18. The designing device as defined in claim 14, wherein said processing means further includes means for generating multiples of said modules for display on said display device.

19. The designing device as defined in claim 14, wherein said processing means further includes means for generating mirror images of said modules for display on said display device.

20. The designing device as defined in claim 14, wherein said processing means further includes means for generating enlargements of said modules for display on said display device.

21. The designing device as defined in claim 1, wherein said storage device includes storage areas containing data for predetermined Jacquard connection structures in said knit image and thread course presentations.

22. The designing device as defined in claim 1, and further comprising a Jacquard generator for the design of the connecting structure of a Jacquard front side with a Jacquard rear side of the knit product in at least one of said knit image and thread course presentations.

23. The designing device as defined in claim 1; and further comprising interactive means for influencing the translation of said design images of said knit product into control data for the knitting machine through said input device.

24. The designing device as defined in claim 23, wherein said storage device includes storage areas for storing frequently used translation algorithms between said design images and control data for the knitting machine as entered by said interactive means.

25. A knitting machine comprising a device for designing knit products to be manufactured on the machine, said designing device comprising at least one storage device for storing data required for the production of the knit products on the knitting machine; at least one display device for displaying design images for the knit products; at least one input device for altering the design images; and means for processing data to be exchanged between said storage, input and display devices, including means for generating at least one knit image presentation and at least one corresponding thread course presentation for display as said design images on said display device, and means for simultaneously correspondingly altering one of said presentations as the other is being altered by using said input device.

26. A method of designing knit products to be manufactured on a knitting machine, comprising the steps of generating at least one knit image presentation and at least one corresponding thread course presentation of the respective knit product; displaying such presentations; and simultaneously correspondingly altering one of said presentations when and as the other is being altered.

27. The method as defined in claim 26, and further comprising the steps of converting the respective one of the knit image presentation and the thread course presentation into design data for the knit product, and storing such design data for shared use in both of the presentations.

* * * * *